United States Patent [19]

Dietrich

[11] 4,109,498

[45] Aug. 29, 1978

[54] FIRE SLEEVE FOR TUBULAR LOCKS

[75] Inventor: Hagen Dietrich, Delta, Canada

[73] Assignee: Norris Industries, South Gate, Calif.

[21] Appl. No.: 809,175

[22] Filed: Jun. 23, 1977

[51] Int. Cl.[2] ..... E05B 9/04

[52] U.S. Cl. ..... 70/449; 70/417

[58] Field of Search ..... 292/357, DIG. 54; 70/448, 449, 451, DIG. 3, 417, 141, 333, 416, 452, DIG. 43

[56] References Cited

U.S. PATENT DOCUMENTS

| | | | |
|---|---|---|---|
| 897,802 | 9/1908 | Voight et al. | 70/452 X |
| 1,661,454 | 3/1928 | Wilson | 70/448 |
| 1,701,994 | 2/1929 | Wilson | 70/449 X |
| 1,719,282 | 7/1929 | Wilson | 70/449 X |
| 1,876,081 | 9/1932 | Schlage | 70/DIG. 3 |
| 2,179,958 | 11/1949 | Schlage | 70/449 X |
| 2,491,783 | 12/1949 | Thomas | 292/357 X |
| 2,779,186 | 1/1957 | Grevengoed et al. | 70/451 |
| 3,128,115 | 4/1964 | Patriquin et al. | 292/357 X |

*Primary Examiner*—Rodney H. Bonck

[57] ABSTRACT

A resilient sleeve is provided as an accessory to enclose the space around a tubular type door lock mechanism mounted in a hole bored through a door. The diameter of the sleeve is normally larger than the diameter of the bore so that after being contracted and a pair of lugs are projected under the edge of the trim on one side, the sleeve will expand to the interior size of the bore and at the same time the lugs will engage beneath the edge of the trim.

6 Claims, 3 Drawing Figures

FIRE SLEEVE FOR TUBULAR LOCKS

A tubular lock or latch set of the type involved in the present disclosure is one for installation in a cylindrical hole which is bored through a door from one face to the other, and into which a lateral bore extends from an edge face of the door to accommodate a latch bolt subassembly. The tubular lock or latch mechanism is customarily one having various operating parts which reside within the bore but which do not fill the bored hole. Where such installations exist on wooden doors, there is always possibility of fire, on one side of the door or the other. In the event of fire, when a door is kept closed as it should be to retard spread of the fire, the lock or latch set is invariably subject to heat as the fire tends progressively to consume the material of the door itself. Inasmuch as a very great many doors are still wooden doors, it can be appreciated that the door may ultimately burn through, but much damage can be averted when the door is prevented from burning through for the longest possible time.

Conditions are commonly present also on the side of the door where the fire exists which result in debris falling down with appreciable prospect that pieces of debris will strike the doorknob, thus tending to loosen or dislodge the lock set. It is commonly appreciated that flames start eroding on the fire side of the door and, finding an unobstructed cavity, cause the trims to loosen and to drop, exposing part of the cross-bore to an extent such that, in terms of the trade, daylight can be seen through the bore. Where there is exposure to that extent there is a materially increased prospect of fire seeking a way through the bore and causing the door installation to become destroyed sooner than it otherwise would. Where the latch assembly is such that the mechansim does not fill the bored hole in the door, the deterioration due to fire is much more rapid. Some lock assemblies concededly are built within a housing which tends to fill the bored hole. Although locks of such type are prevalent, there are many thousands of locks not constructed in such fashion, and there is an appreciable problem involved in putting such installations in condition where they can effectively retard a fire, and incidentally meet fire specifications. Further still, where this problem prevails, the door thickness involved tends to decrease as combustion proceeds, this tending to loosen the trims of a lock installation, thereafter causing the lock to drop and completely expose the bore hole.

It is therefore among the objects of the invention to provide a new and improved fire retardant structure for a tubular type lock installation of such character that it closes the bored hole, thereby to materially retard the prospect of a burning through of the door when fire is encountered.

Another object of the invention is to provide a new and improved fire retarding impediment for a tubular type lock installation which is very simple and inexpensive in its construction and which can be readily installed in both new installations and those previously installed.

Still another object of the invention is to provide a new and improved fire retarding expedient for a tubular type lock installation which readily snaps into place when the lock parts are assembled on the door and which thereafter assumes a position with respect to the bore hole through the door which is best suited to keeping the bored hole from being opened through the door as a result of fire on one side or the other.

Still further among the objects of the invention is to provide a new and improved expedient for retarding fire through a door equipped with a tubular type lock installation wherein the added accessory consists of a single piece of material initially formed in such a fashion that it can be readily snapped into place in such an installation and thereafter assume the most advantageous position for retarding the effects of fire, the device being further suitable for lock installations where door preparations for receiving them are less than precise, because of the non-rigid assembly of the accessory with respect to the lock hardware itself.

With these and other objects in view, the invention sonsists of the construction, arrangement, and combination of the various parts of the device, whereby the objects contemplated are attained, as hereinafter set forth, pointed out in the appended claims and illustrated in the accompanying drawings.

Figure 1:
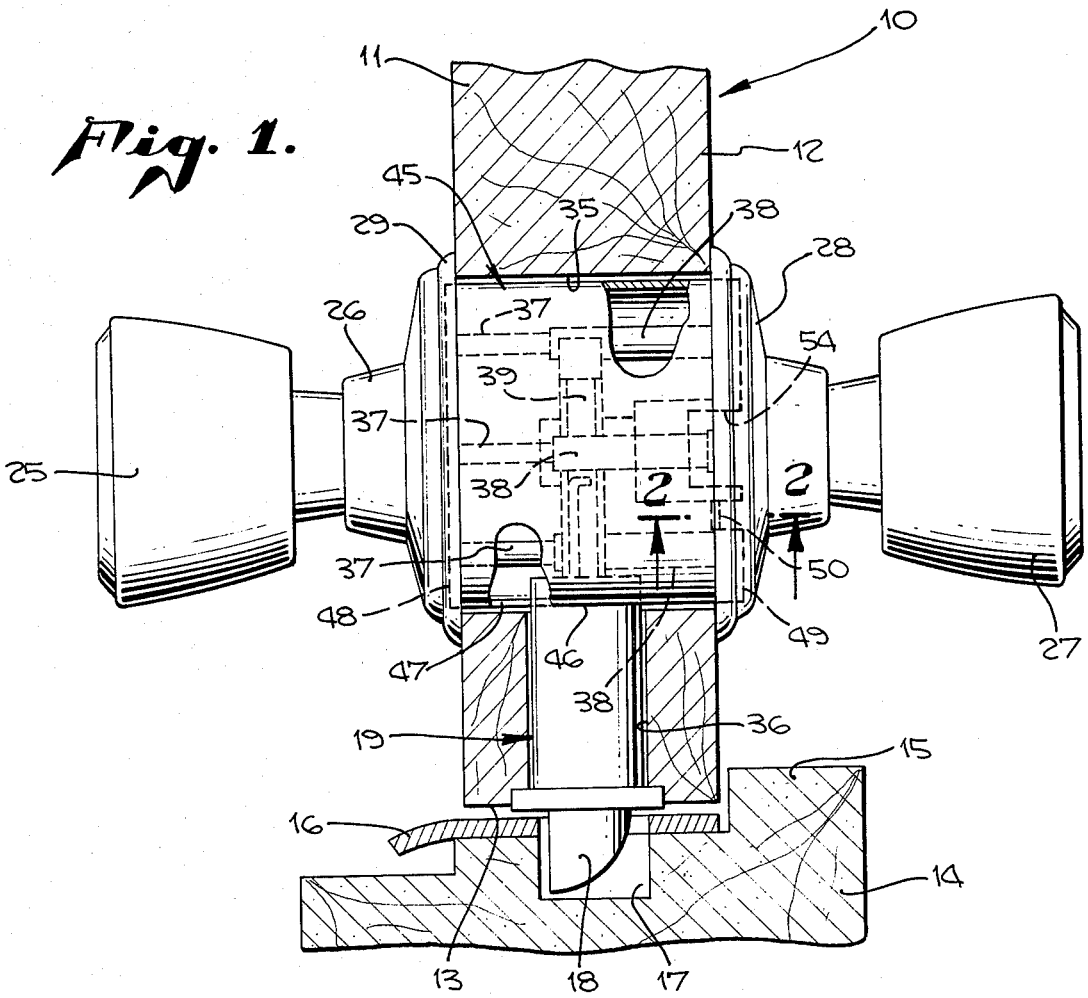
FIG. 1 is a sectional view of a typical door and adjacent frame showing a tubular type lock installation equipped with the invention in place.

In an embodiment of the invention, there is shown a conventional door 10 having respective outside and inside faces 11 and 12 and edge face 13. The door is shown in a position to operate in connection with a frame 14 having a door stop 15 and provided with a strike plate 16. There is a conventional recess 17 in the frame 14 for accommodation of a bolt head 18 of a conventional latch bolt subassembly 19.

A tubular type doorlock chosen by way of illustration includes an outside knob 25 in operative association with an outside trim subassembly 26 which is applied against the outside face 11 of the door 10. On the other side is an inside knob 27 in operative association with an inside trim subassembly 28 for application against the inside face 12 of the door 10.

Figure 2:
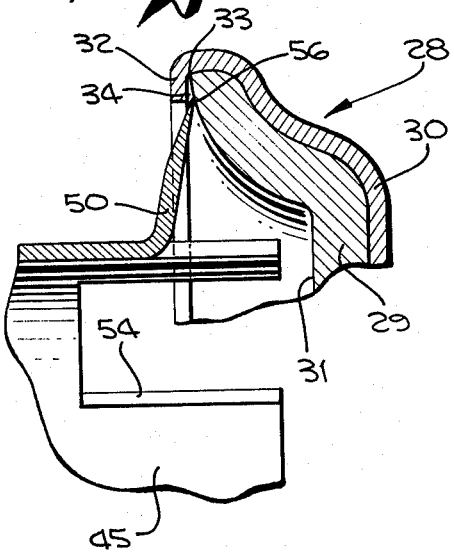
FIG. 2 is a fragmentary cross-sectional view on the line 2—2 of FIG. 1.
Figure 3:
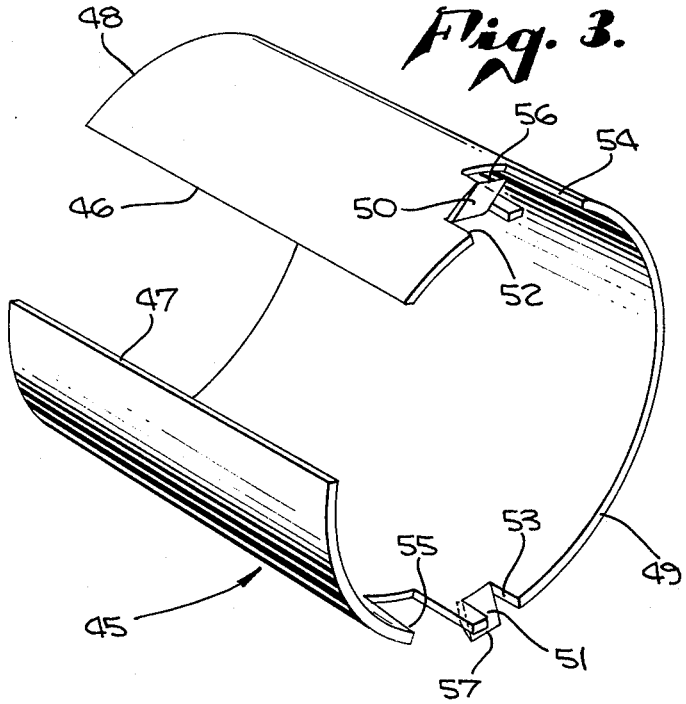
FIG. 3 is a side perspective view of the sleeve of the fire retardant installation of FIGS. 1 and 2.

By way of example there is shown particularly, in FIG. 2, a section of the inside trim subassembly 28 consisting in particular of a rose liner 29 and rose cover 30. The rose liner 29 is complementary with respect to the interior face of the rose cover, and additionally is provided with a central depression or recess 31. At the perimeter of the rose cover there is a circumferential inwardly turned lip 32 which is spaced a short distance from a surface 33 of the rose liner 29 forming a circumferential recess means 34.

For the type of installation here under consideration, there is a cylindrical bore 35 which extends transversely through the door 10 from one face to the other forming, in effect, a bored hole. Further following conventional construction there is a smaller edge bore 36 which extends from the edge face 13 into the door to a point where it connects with the bore 35. The outside trim subassembly 26 is connected to the inside trim subassembly 28 by use of posts 37 which slide into tubes 38, the posts being on the outside trim assembly and tubes on the inside trim assembly. The tubes accommodate conventional screws (not shown) which extend through the rose liner and the respective tubes into the posts. Although three such post and tube combinations are shown suggesting employment of four, occasions prevail where no more than two may be used. The lock parts held together as described provide for interconnection of the knobs with the latch bolt subassembly 19 through a roll back 39 suggested by the phantom lines at the center of the installation.

To complete the installation there is provided a sleeve 45, cylindrical in form and longitudinally split providing spaced parallel edges 46 and 47. These edges define a rather ample space between them extending for the length of the sleeve 45. One end edge 48 is adapted to extend into position against one of the rose liners 29, preferably that of the outside trim assembly. Another end edge 49 is adapted to extend against the other rose liner, preferably of the inside trim assembly 28.

In the chosen embodiment there are provided two tabs 50 and 51 which extend radially outwardly from the outer circumference of the sleeve 45. The tabs are in fact outwardly bent portions of the material of the sleeve itself cut along respective lines 52 and 53. It has also been found advantageous, especially for some installations, to provide a cutout portion 54 of the wall of the sleeve adjacent the tab 50 and a similar cutout portion 55 in the wall of the sleeve adjacent the tab 51.

The sleeve 45 is preferably made from a piece of resilient sheet metal which normally has a condition or size expanded to a diameter exceeding the diameter of the bore 35. When the sleeve is to be applied, it is compressed to a condition wherein the diameter is less than the diameter of the bore 35, in fact sufficiently less so that tapered end edges 56 and 57 of the respective tabs 50 and 51 clear the inner edge of the circumferential lip 32 after which, when the sleeve is released, it expands to a condition wherein the tabs 50 and 51 are projected into the circumferential recess means 34 as shown in FIG. 2. The sizing of the sleeve is further calculated so that in operative expanded condition as shown in FIGS. 1 and 2 the sleeve expands to a condition where the outer circumference of the sleeve is substantially adjacent or coincident with the interior of the bore 35, thus to effectively close the bore. In this condition also the opposite edges 46 and 47 lie immediately adjacent opposite sides of the latch bolt subassembly 19.

By having the length of the sleeve 45 slightly greater than the anticipated thickness of the door, and tilting the tabs 50 and 51, the tabs are readily forced into the recess means 34 during assembly of the trims.

The arrangement compensates for a slightly thicker door by allowing the edge 48 after assembly of the inner trim, to protrude that much more. In the case of a thinner door, as the mounting screws are tightened, the tabs 50 and 51 will be forced, or bent, more to a right angular position, relative to the sleeve. As a consequence, the edge 48 will shift a comparable distance to, in effect, diminish the effective length of the sleeve to match the diminished thickness of the door.

A resulting advantage is that of allowing for maximum engagement of the sleeve 45 with relation to both trims when accommodating various door thicknesses due to manufacturing tolerances and in that way to produce a more rigid lock mounting even after a fire.

Constructed and installed as shown and described, the sleeve inhibits a condition wherein daylight shows between opposite sides of a door when fire is burning on the one side or the other under the conditions heretofore made reference to. The sleeve remains an obstruction in the cavity and holds the trims in place even though one or another of the trims may loosen under the adverse conditions then prevailing. The result is to keep the opening essentially closed and materially extend the time during which the door serves as a deterrent to the spread of the fire.

Further still it will be noted that the structure, shape and size of the sleeve 45 is such that it can perform as an obstruction even though the bore 35 might be somewhat inexpertly made, either too large or too small or, for example, imprecisely located. The structure of the sleeve is further such that it can accommodate itself very readily and effectively to lock installations which may differ to a degree in size and configuration, or the position and alignment of the posts and tubes which interconnect the opposite rose liners. Where tubes of some special type having a larger base than usual might be encountered, the cutout portions 54 and 55 can accommodate such a circumstance.

Having described the invention, what is claimed as new in support of Letters Patent is as follows:

1. In a tubular type lock installation for a door of conventional thickness having a bore therethrough from one face to the other having a length equal to the door thickness and wherein the tubular type lock has a latch bolt subassembly extending from one side and a trim liner and trim cover in overlying relationship, a radially inwardly extending flange on the trim cover spaced from the trim liner forming with the liner a perimetrically located recess means therebetween on one face only of the door, the improvement comprising a fire resistant split sleeve of metallic material having a length at least equal to the length of the bore and a plurality of tabs with end edges of substantially reduced thickness adjacent one end only projecting radially outwardly beyond the perimeter, said sleeve having a potentially outwardly urged condition with a diameter greater than the diameter of the bore and subject to compression to a diameter wherein said tabs lie radially inwardly of the perimetrically located recess means and substantially in diametrical alignment in operative condition, said sleeve in operative condition being partially expanded to a size wherein the perimetrical surface of the sleeve is in substantial engagement with the wall of the bore and the end edges of the tabs are projected into the recess means.

2. The improvement of claim 1 wherein there are opposite spaced parallel longitudinal edges on one side of the sleeve at the split portion forming a space therebetween in operating condition spanning said latch bolt subassembly and wherein the entire exterior surface of the sleeve has a right cylindrical form.

3. The improvement of claim 1 wherein the length of the sleeve is in excess of the door thickness.

4. The improvement of claim 1 wherein the tabs are tilted slightly in a direction toward the end of the sleeve on which they are located.

5. The improvement of claim 1 wherein there are cut out clearance portions of the sleeve at the end edge adjacent said tabs and a strip of the material of said sleeve located between each tab and the respective cut out clearance portion.

6. A fire retardant tubular type door lock installation wherein there is a cylindrical bore through the door from face to face, said lock comprising inside and outside trim subassemblies each including a hand hold, a trim liner and a trim cover overlying the liner with a circumferential inwardly turned lip on the trim cover overlying the liner and forming a recess therebetween, each trim liner having a central depression on the side facing the door, said lock including a latch bolt subassembly extending from one side outwardly of the bore, and a plurality of sets of posts and tubes extending between the trim liners on opposite faces of the door for holding the lock in position, and a sleeve of metal having a longitudinal split with opposite parallel edges on respective opposite sides of the latch bolt subassembly, a plurality of radially outwardly bent tabs of said sleeve material in diametrical alignment at one end of the sleeve lodged in said recess, said sleeve having an operative condition wherein the outer wall lies in snug relationship with the interior of said bore and opposite end edges lie within depression of the respective trim liner.

* * * * *